US009422907B2

(12) United States Patent
Yoshikawa

(10) Patent No.: US 9,422,907 B2
(45) Date of Patent: Aug. 23, 2016

(54) START CONTROL DEVICE FOR OUTBOARD MOTOR, START CONTROL METHOD FOR OUTBOARD MOTOR, AND PROGRAM

(71) Applicant: SUZUKI MOTOR CORPORATION, Hamamatsu-shi, Shizuoka (JP)

(72) Inventor: Yukihiro Yoshikawa, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 14/650,367

(22) PCT Filed: Aug. 14, 2013

(86) PCT No.: PCT/JP2013/071901
§ 371 (c)(1),
(2) Date: Jun. 8, 2015

(87) PCT Pub. No.: WO2014/091794
PCT Pub. Date: Jun. 19, 2014

(65) Prior Publication Data

US 2015/0300306 A1 Oct. 22, 2015

(30) Foreign Application Priority Data

Dec. 13, 2012 (JP) ..... 2012-272680

(51) Int. Cl.
*B63H 20/00* (2006.01)
*F02N 11/08* (2006.01)
(Continued)

(52) U.S. Cl.
CPC ..... *F02N 11/0807* (2013.01); *B63H 20/00* (2013.01); *B63H 21/21* (2013.01);
(Continued)

(58) Field of Classification Search
CPC .... B63H 20/14; B63H 21/21; B63H 21/213; B63H 20/00; B63H 21/32; F02N 11/0807; B63J 99/00; B63B 2017/0009; F02M 35/168; F02D 29/02; F02D 31/002
See application file for complete search history.

(56) References Cited

U.S. PATENT DOCUMENTS 6,024,068 A 2/2000 Nakase et al.
2003/0089291 A1 5/2003 Kanno et al.
(Continued)

FOREIGN PATENT DOCUMENTS

JP H10153135 A 6/1998
JP 2003127987 A 5/2003
(Continued)

OTHER PUBLICATIONS

International Preliminary Report on Patentability mailed on Jun. 25, 2015 issued in corresponding PCT Application No. PCT/JP2013/071901.
(Continued)

*Primary Examiner* — Behrang Badii
(74) *Attorney, Agent, or Firm* — Troutman Sanders LLP

(57) ABSTRACT

A start control device (20) for an outboard motor (40) has: a determination unit (64) determining whether or not an emergency switch (31) is on when a first switch is operated by a boat operator; a start instruction unit (65) instructing a start of the outboard motor (40) when the determination unit (64) determines that the emergency switch (31) is not on; and a stop instruction unit (66) instructing a stop of a supply of electric power to the outboard motor (40) when the determination unit (64) determines that the emergency switch (31) is on. It is possible to make a state where the electric power is supplied to the outboard motor (40) shift to a state where the supply of electric power to the outboard motor (40) is stopped without starting the outboard motor (40).

5 Claims, 5 Drawing Sheets

(51) Int. Cl.

| | |
|---|---|
| ***B63J 99/00*** | (2009.01) |
| *B63H 20/14* | (2006.01) |
| *B63H 21/21* | (2006.01) |
| *B63B 17/00* | (2006.01) |
| *F02B 61/04* | (2006.01) |

(52) U.S. Cl.
CPC ..... *B63J 99/00* (2013.01); *F02N 11/0803* (2013.01); *B63B 2017/0009* (2013.01); *B63H 20/14* (2013.01); *B63H 21/213* (2013.01); *F02B 61/045* (2013.01)

(56) References Cited

U.S. PATENT DOCUMENTS

2005/0192735 A1 9/2005 Ito et al.
2006/0106525 A1 5/2006 Hata
2009/0221195 A1* 9/2009 Suzuki ..... B63H 21/213 440/86
2011/0137500 A1 6/2011 Shinogi et al.
2011/0294376 A1* 12/2011 Kuriyagawa ..... B63H 20/14 440/86

FOREIGN PATENT DOCUMENTS

JP 2005248710 A 9/2005
JP 2006137338 A 6/2006
JP 2011121448 A 6/2011

OTHER PUBLICATIONS

International Search Report dated Nov. 19, 2013, which issued during prosecution of International Application No. PCT/JP2013/071901.

* cited by examiner

START CONTROL DEVICE FOR OUTBOARD MOTOR, START CONTROL METHOD FOR OUTBOARD MOTOR, AND PROGRAM

CROSS REFERENCE TO RELATED APPLICATIONS

The present application is the U.S. National Phase of International Patent Application Serial No. PCT/JP2013/071901, filed Aug. 14, 2013, which claims priority to Japanese Patent Application Serial No. 2012-272680, filed Dec. 13, 2012. The contents of the foregoing applications are hereby incorporated by reference in their entireties.

TECHNICAL FIELD

The present invention relates to a start control device for an outboard motor, a start control method for an outboard motor, and a program. In particular, the present invention is suitable for being used in a case where cancellation and execution of security of an outboard motor are conducted by using an electronic key.

BACKGROUND ART

In order to start or stop an outboard motor, an ignition switch provided to an outboard motor main body or provided in an operation cabin has been conventionally used. Concretely, by inserting a key into the ignition switch, and rotating the ignition switch in stages, the ignition is turned on, and then a start SW is turned on, which starts the outboard motor.

In recent years, a demand for improving a security of a boat and an outboard motor has been increasing. However, in the outboard motor which is started by the ignition switch described above, it cannot be always said that the perfect security is provided. Therefore, it can be considered that, with respect to the boat and the outboard motor as well, an engine start system in which a key is not required as disclosed in Patent Literature 1, for example, is employed to improve the security. In Patent Literature 1, only when an encryption code received from a portable machine coincides with a collation code, a steering lock is unlocked so that an operation is allowed, which enables to improve the security.

CITATION LIST

Patent Literature

Patent Literature 1: Japanese Laid-open Patent Publication No. 2006-137338

SUMMARY OF INVENTION

Technical Problem

One switch is used in the engine start system in Patent Literature 1, in which an authentication of the portable machine is performed and a steering lock is unlocked by pressing-down the switch for the first time, an authentication of the portable machine is performed again to turn on the system by pressing-down the switch for the second time, and the engine is started by pressing-down the switch for the third time. However, a user does not always want to start the engine, and it is also possible to suppose a case where the user wants to turn off the system, from the state where the system is turned on, without starting the engine. In this case, in a four-wheel vehicle and the like, for example, it can be considered to switch whether to start the engine or to turn off the system in accordance with whether or not a brake pedal is depressed at the time of pressing-down the one switch. For example, it is possible to employ a method such that the engine is started by pressing-down the switch while depressing the brake pedal from the state where the system is turned on, and the system is turned off by pressing-down the switch without depressing the brake pedal from the state where the system is turned on.

However, since the brake pedal is not provided to the outboard motor, it is difficult to perform the switching with a method similar to that of the four-wheel vehicle. Further, when a switch or the like is newly added for switching the start of the engine and the turning-off of the system, a product cost is increased.

The present invention is made in view of the problems as described above, and an object thereof is to enable, even in an outboard motor system in which cancellation and execution of security of an outboard motor are conducted in accordance with an authentication of a portable machine, a state where electric power is supplied to the outboard motor (ignition-on state) to shift to a state where the supply of electric power to the outboard motor is stopped (ignition-off state) without starting the outboard motor.

Solution to Problem

A start control device for an outboard motor of the present invention is a start control device for an outboard motor performing a control to start and stop the outboard motor in accordance with an instruction made by a boat operator, the start control device for the outboard motor including: an authentication means performing an authentication of a portable machine carried by the boat operator via a communication part in accordance with an operation of a first switch made by the boat operator; an electric power supply instruction means instructing a supply of electric power to the outboard motor based on a success of the authentication of the portable machine performed by the authentication means; a security cancellation instruction means instructing a cancellation of security of the outboard motor based on the success of the authentication of the portable machine performed by the authentication means; a determination means determining whether or not an emergency switch is on when the first switch is operated by the boat operator in the state where the electric power is supplied to the outboard motor in accordance with the instruction made by the electric power supply instruction means, and the security of the outboard motor is cancelled in accordance with the instruction made by the security cancellation instruction means; a start instruction means instructing the start of the outboard motor when the determination means determines that the emergency switch is not on; and a stop instruction means instructing a stop of the supply of electric power to the outboard motor when the determination means determines that the emergency switch is on.

A start control method for an outboard motor of the present invention is a start control method for an outboard motor performing a control to start and stop the outboard motor in accordance with an instruction made by a boat operator, the start control method for the outboard motor including: an authentication step of performing an authentication of a portable machine carried by the boat operator via a communication part in accordance with an operation of a first switch made by the boat operator; an electric power supply instruction step of instructing a supply of electric power to the outboard motor based on a success of the authentication of the portable machine performed by the authentication step; a security cancellation instruction step of instructing a cancellation of security of the outboard motor based on the success of the authentication of the portable machine performed by the authentication step; a determination step of determining whether or not an emergency switch is on when the first switch is operated by the boat operator in the state where the electric power is supplied to the outboard motor in accordance with the instruction made by the electric power supply instruction step, and the security of the outboard motor is cancelled in accordance with the instruction made by the security cancellation instruction step; a start instruction step of instructing the start of the outboard motor when the determination step determines that the emergency switch is not on; and a stop instruction step of instructing a stop of the supply of electric power to the outboard motor when the determination step determines that the emergency switch is on.

A program of the present invention is a program for performing a control to start and stop an outboard motor in accordance with an instruction made by a boat operator, the program causing a computer to execute: an authentication step of performing an authentication of a portable machine carried by the boat operator via a communication part in accordance with an operation of a first switch made by the boat operator; an electric power supply instruction step of instructing a supply of electric power to the outboard motor based on a success of the authentication of the portable machine performed by the authentication step; a security cancellation instruction step of instructing a cancellation of security of the outboard motor based on the success of the authentication of the portable machine performed by the authentication step; a determination step of determining whether or not an emergency switch is on when the first switch is operated by the boat operator in the state where the electric power is supplied to the outboard motor in accordance with the instruction made by the electric power supply instruction step, and the security of the outboard motor is cancelled in accordance with the instruction made by the security cancellation instruction step; a start instruction step of instructing the start of the outboard motor when the determination step determines that the emergency switch is not on; and a stop instruction step of instructing a stop of the supply of electric power to the outboard motor when the determination step determines that the emergency switch is on.

Advantageous Effects of Invention

According to the present invention, it is possible to make a state where electric power is supplied to an outboard motor (ignition-on state) shift to a state where the supply of electric power to the outboard motor is stopped (ignition-off state) without starting the outboard motor.

DESCRIPTION OF EMBODIMENTS

Hereinafter, a preferred embodiment of the present invention will be described with reference to the attached drawings.

Figure 1:
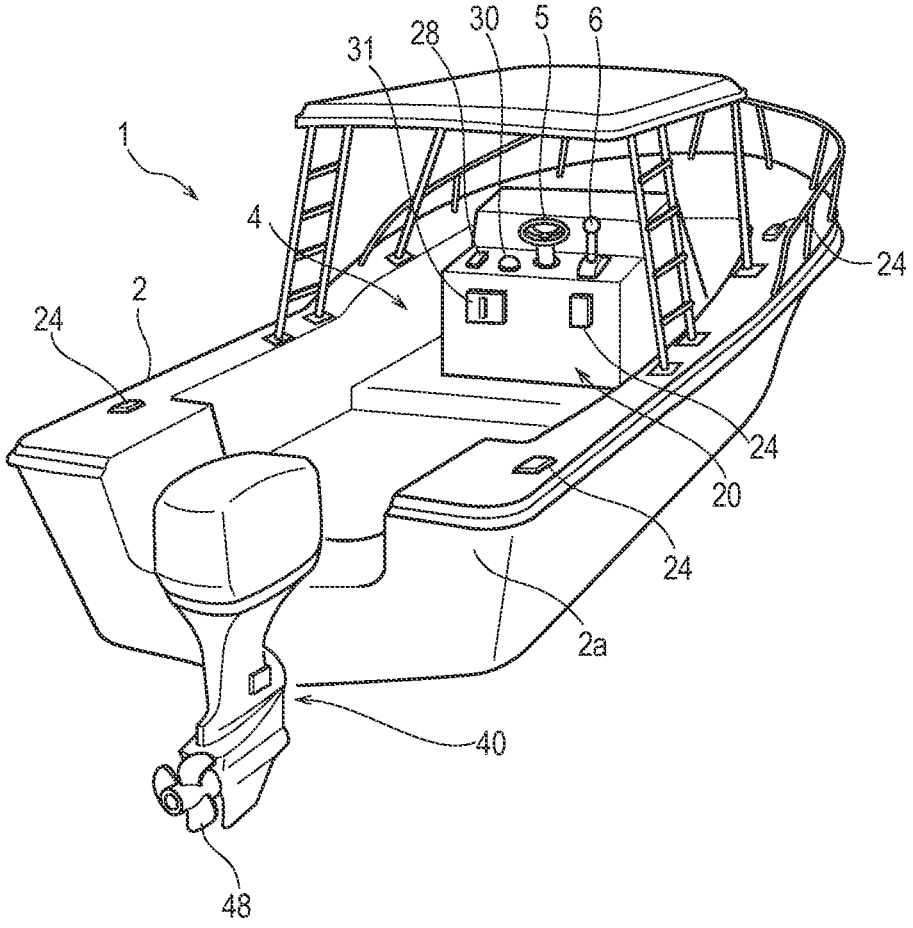
FIG. 1 is a perspective view of a boat when seen from a diagonally rear direction.

FIG. 1 is a perspective view of a boat when seen from a diagonally rear direction. As illustrated in FIG. 1, to a transom 2*a* located on a rear part of a hull 2 of a boat 1, an outboard motor 40 having a propeller 48 is attached via a bracket device.

An operation cabin 4 is provided in an almost middle part of the hull 2. In the operation cabin 4, a steering handle 5 for steering the boat 1 and a remote control lever 6 are disposed. Further, in the operation cabin 4, a start control device 20 for an outboard motor 40 is disposed. The start control device 20 performs a control to start or stop the outboard motor 40, and performs a control to cancel or execute a security of the outboard motor 40.

FIG. 1 illustrates, out of components of the start control device 20, a communication part 24, a battery SW 28, a start SW 30, and an emergency SW 31. The start control device 20 performs wireless communication with a later-described portable machine 10 carried by a boat operator, via the communication part 24. The start control device 20 performs an authentication based on an encryption code received from the portable machine 10, and in accordance with a result of the authentication, it instructs the outboard motor 40 to cancel the security or execute the security. Further, the start control device 20 starts the authentication in accordance with an operation of the start SW 30 made by the boat operator, and instructs the outboard motor 40 to start or stop. Further, the start control device 20 instructs the outboard motor 40 to stop in accordance with an operation of the emergency SW 31 made by the boat operator in an emergency.

Here, as illustrated in FIG. 1, the communication part 24 of the present embodiment is disposed in, other than the operation cabin 4, a plurality of places such as a bow and a stern. Specifically, a plurality of the communication parts 24 are disposed so that the communication with the start control device 20 can be performed as long as the boat operator who carries the portable machine 10 exists in the hull 2. Therefore, even if the boat operator who carries the portable machine 10 does not exist in the operation cabin 4, as long as he/she exists in the hull 2, the authentication can be conducted with the portable machine 10 even if another person operates the start SW 30. Therefore, even the other person can steer the outboard motor 40.

Figure 2:
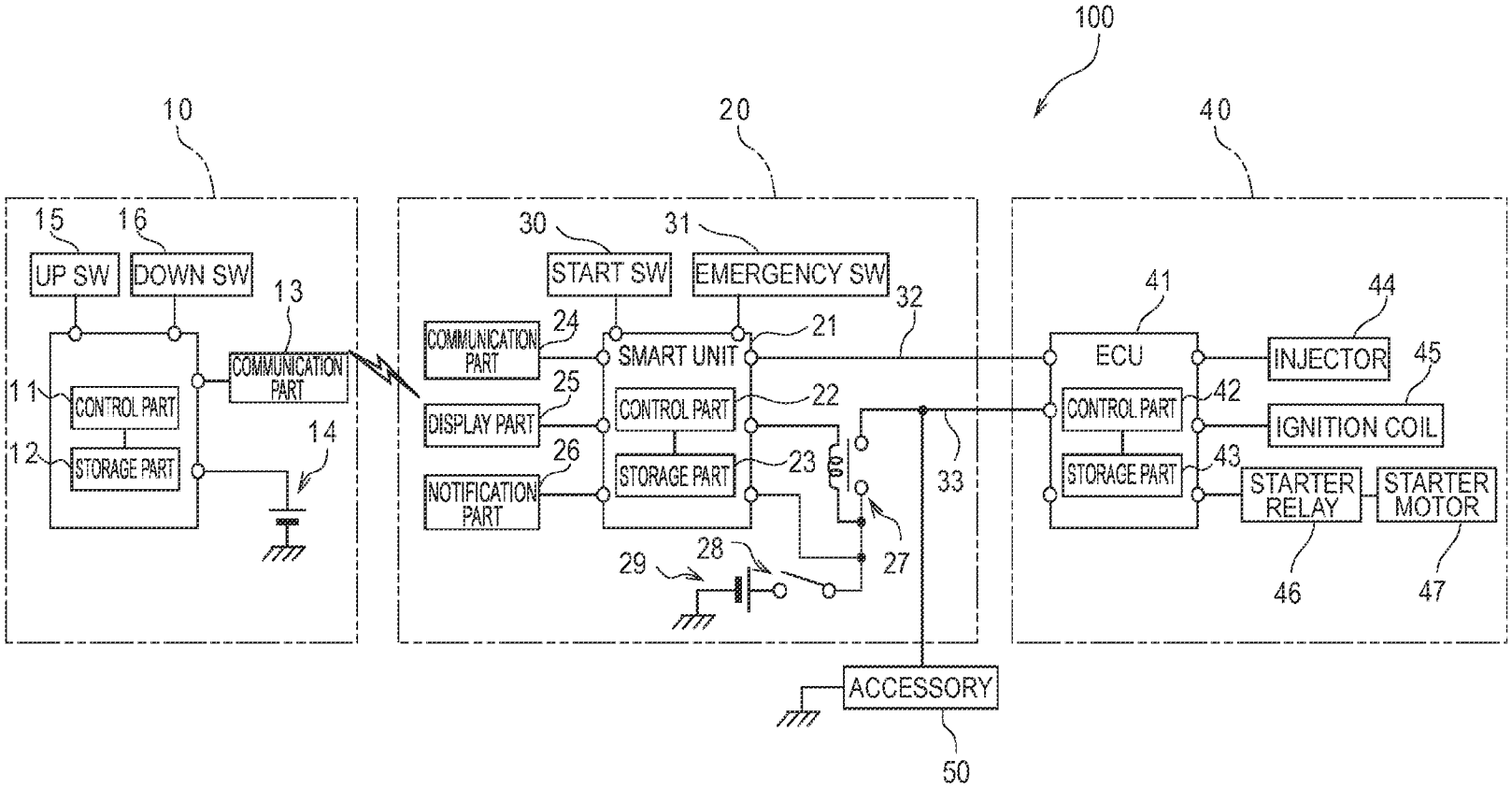
FIG. 2 is a block diagram illustrating a configuration of an outboard motor system.

FIG. 2 is a block diagram illustrating a configuration of an outboard motor system 100. In FIG. 2, components same as those in FIG. 1 are denoted by the same reference numerals. Hereinafter, a concrete configuration of the outboard motor system 100 will be described. The outboard motor system 100 has the portable machine 10, the start control device 20, and the outboard motor 40.

The portable machine 10 is a so-called electronic key capable of being carried by the boat operator. The portable machine 10 can perform wireless communication with the start control device 20. The portable machine 10 has a control part 11, a storage part 12, a communication part 13, a battery 14, an up SW 15, a down SW 16 and the like.

The control part 11 controls the entire portable machine 10. The control part 11 transmits, in accordance with an instruction made by the start control device 20, an encryption code stored in the storage part 12 to the start control device 20. The storage part 12 stores a program executed by the control part 11, the encryption code and the like. The communication part 13 is an antenna, for example, and transmits/receives data to/from the communication part 24 of the start control device 20. The battery 14 supplies electric power to the control part 11 and the like.

The up SW 15 and the down SW 16 are switches which are pressed-down when the boat operator wants to adjust a power of the outboard motor 40 at a time of berthing the boat 1, and the like. Concretely, the up SW 15 and the down SW 16 are switches which are pressed-down when the boat operator wants to adjust an engine speed of the outboard motor 40 within a low speed range. The up SW 15 is a switch which is pressed-down when the boat operator wants to increase the engine speed within the low speed range. The down SW 16 is a switch which is pressed-down when the boat operator wants to decrease the engine speed within the low speed range. When the up SW 15 or the down SW 16 is pressed-down, the control part 11 transmits a signal corresponding to the up SW 15 or the down SW 16 to the start control device 20 via the communication part 13.

The start control device 20 can communicate with the portable machine 10 and the outboard motor 40. The start control device 20 has a smart unit 21, the communication part 24, a display part 25, a notification part 26, a power source relay 27, a battery SW 28, a battery 29, a start SW 30, an emergency SW 31 and the like. Further, the smart unit 21 configures a so-called computer including a control part 22 and a storage part 23.

The control part 22 controls the entire start control device 20. The control part 22 performs an authentication based on the encryption code received from the portable machine 10, and instructs, in accordance with a result of the authentication, the outboard motor 40 to cancel the security or to execute the security. Further, in accordance with an operation of the start SW 30, the control part 22 instructs the outboard motor 40 to start or stop. The storage part 23 stores a program executed by the control part 22, an encryption code for collation (referred to as a collation code, hereinafter) and the like. The communication part 24 is an antenna, for example, and transmits/receives data to/from the communication part 13 of the portable machine 10. The display part 25 is a liquid crystal monitor, for example, and displays a driven state and the like of the outboard motor 40. The notification part 26 is a buzzer, an LED or the like, for example, and performs notification to the boat operator using a sound or light.

The power source relay 27 is disposed in the middle of a power source cable 33 which connects the battery 29 and the outboard motor 40. The power source relay 27 is controlled to be turned on or off by the control part 22. The battery SW 28 is disposed between the battery 29 and the smart unit 21. When the battery SW 28 is turned on by the boat operator, the electric power is supplied from the battery 29 to the smart unit 21. Further, when the battery SW 28 is turned off by the boat operator, the supply of electric power from the battery 29 to the smart unit 21 is stopped. The battery 29 also supplies electric power to the start control device 20, the outboard motor 40, and a later-described accessory 50.

The start SW 30 is, for example, a push switch as a first switch. The start SW 30 is a switch which is pressed-down when the boat operator starts or stops the outboard motor 40.

The emergency SW (emergency switch) 31 is a switch for stopping the outboard motor 40 in an emergency, and an insertion/extraction member can be inserted/extracted into/from the switch. In a state where the insertion/extraction member is inserted into the emergency SW 31, the emergency SW 31 is off, and it is possible to continuously drive the outboard motor 40. On the other hand, in a state where the insertion/extraction member is extracted from the emergency SW 31, the emergency SW 31 is turned on, and the control part 22 stops the outboard motor 40. Normally, the insertion/extraction member is connected to the boat operator via a code. Therefore, if the boat operator falls into water, for example, the insertion/extraction member is extracted from the emergency SW 31, so that the emergency SW 31 is turned on, resulting in that the outboard motor 40 stops.

The outboard motor 40 can perform communication with the start control device 20 via a communication cable 32. Although explanation will be made on a case where the outboard motor 40 of the present embodiment rotates the propeller 48 using an engine, the present invention is not limited to this case, and can also be applied to an electric outboard motor which rotates the propeller 48 using a motor. The outboard motor 40 has an ECU 41, an injector 44, an ignition coil 45, a starter relay 46, a starter motor 47 and the like. Further, the ECU 41 is configured by including a control part 42 and a storage part 43.

The control part 42 controls the entire outboard motor 40. In accordance with an instruction made by the start control device 20, the control part 42 cancels the security of the outboard motor 40 or executes the security of the outboard motor 40. Here, the security includes a mechanical locking method of locking a predetermined member of the outboard motor 40, an electrical locking method in which the control part 42 prevents the operation of the predetermined member, and the like. Further, the control part 42 starts or stops the outboard motor 40 in accordance with an instruction made by the start control device 20. The storage part 43 stores a program executed by the control part 42 and the like. The injector 44 injects a fuel in accordance with an instruction made by the control part 42. The ignition coil 45 ignites an ignition plug in accordance with an instruction made by the control part 42. The starter relay 46 is turned on in accordance with an instruction made by the control part 42, to thereby drive the starter motor 47. The starter motor 47 forcibly rotates a crankshaft to start the outboard motor 40.

Further, to the outboard motor system 100, the accessory 50 can be connected. The accessory 50 is, for example, a fish finder or the like. The accessory 50 is connected to the power source cable 33 between the power source relay 27 and the outboard motor 40. When the battery SW 28 is turned on and the power source relay 27 is turned on, the electric power is supplied to the accessory 50 from the battery 29. Specifically, the accessory 50 can be used even if the outboard motor 40 is not started.

In the outboard motor system 100 configured as described above, the boat operator sometimes wants to stop, from the state where the electric power is supplied from the battery 29 to the outboard motor 40, the supply of electric power to the outboard motor 40 without starting the outboard motor 40. This concretely indicates a case where the boat operator wants to use only the accessory 50 without starting the outboard motor 40, and to stop, after using the accessory 50, the supply of electric power to the accessory 50 and the outboard motor 40, and the like. In the outboard motor system 100 of the present embodiment, it is possible to stop the supply of electric power to the accessory 50 and the outboard motor 40, through a relatively simple operation conducted by the boat operator.

Figure 3:
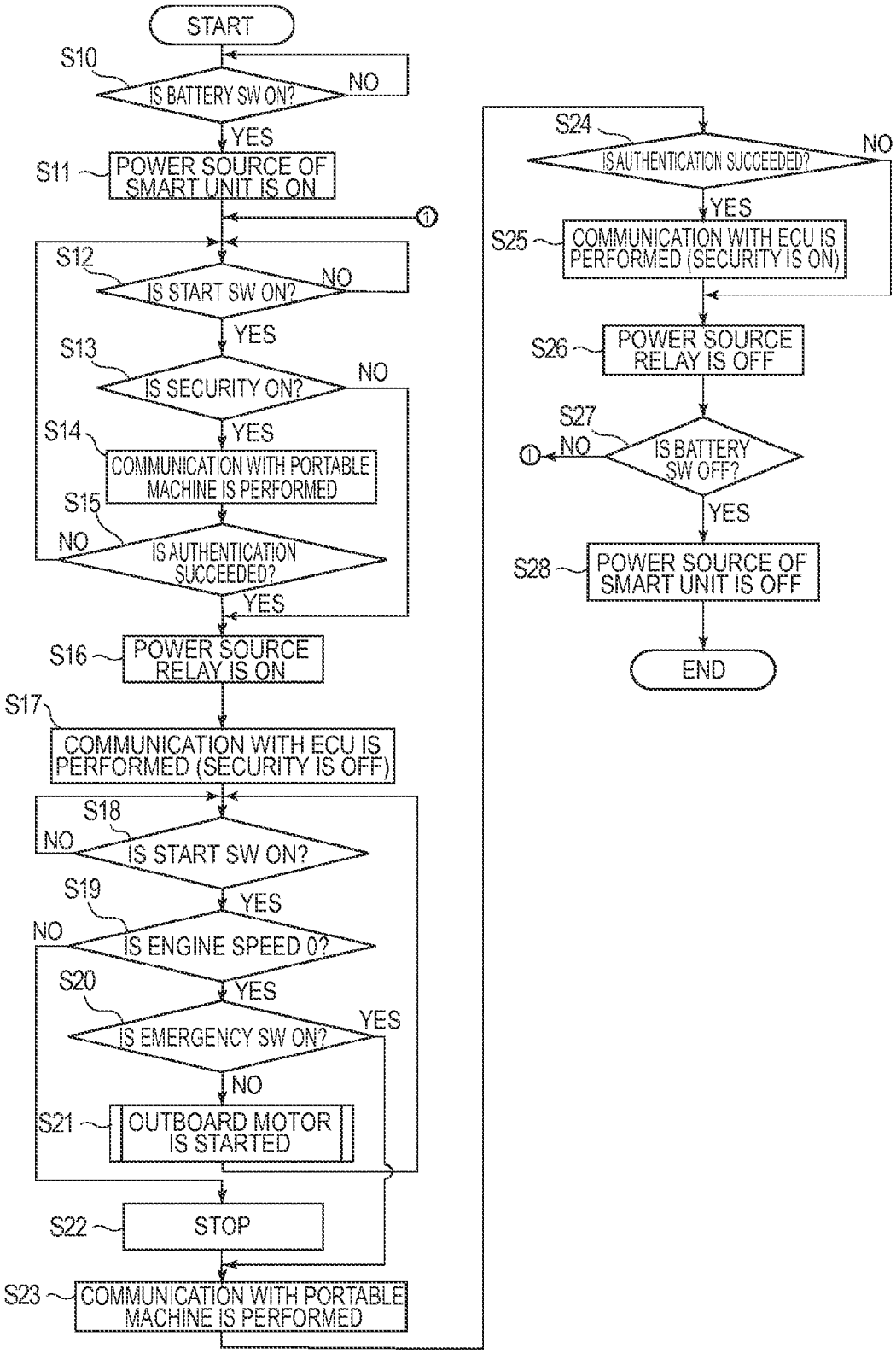
FIG. 3 is a flowchart illustrating processing of a start control device for an outboard motor.

Hereinafter, processing performed by the outboard motor system 100 of the present embodiment will be described with reference to a flowchart illustrated in FIG. 3. The flowchart illustrated in FIG. 3 is realized when the control part 22 of the smart unit 21 in the start control device 20 executes the program stored in the storage part 23. Further, processing conducted by the portable machine 10 is realized when the control part 11 of the portable machine 10 executes the program stored in the storage part 12, and processing conducted by the outboard motor 40 is realized when the control part 42 of the ECU 41 of the outboard motor 40 executes the program stored in the storage part 43.

First, in step S10, the control part 22 of the smart unit 21 determines whether or not the battery SW 28 is turned on by the boat operator. When the battery SW 28 is turned on, the process proceeds to step S11.

In step S11, the control part 22 activates the entire start control device 20 including the smart unit 21 with the use of the electric power supplied from the battery 29.

In step S12, the control part 22 determines whether or not the start SW 30 is turned on by the boat operator. When the start SW 30 is turned on, the process proceeds to step S13, and when it is not turned on, the control part 22 waits until the start SW 30 is turned on.

In step S13, the control part 22 checks the security, and determines whether or not the security is being executed. For example, by reading information stored in the storage part 23 indicating that the security is executed, the control part 22 can determine whether or not the security is being executed. When the security is being executed, the process proceeds to step S14, and when the security is not being executed, the process proceeds to step S16.

In step S14, the control part 22 performs wireless communication with the portable machine 10 via the communication part 24, and performs an authentication of the portable machine 10. This processing corresponds to one example of processing performed by an authentication means. As described above, the plurality of communication parts 24 are disposed in the hull 2, so that as long as the boat operator who carries the portable machine 10 exists in the hull 2, it is possible to perform the wireless communication with the portable machine 10. Therefore, even if a person who operates the start SW 30 in step S12 is not the boat operator who carries the portable machine 10, the authentication is conducted. Concretely, the control part 22 transmits, to the portable machine 10, an instruction indicating the transmission of encryption code. The control part 11 of the portable machine 10 transmits, in accordance with the instruction, the encryption code stored in the storage part 12 to the start control device 20.

In step S15, the control part 22 performs an authentication whether or not the received encryption code coincides with a collation code stored in the storage part 23. When the encryption code and the collation code coincide with each other and the authentication is succeeded, the process proceeds to step S16. On the other hand, in the case where the encryption code and the collation code do not coincide with each other and the authentication does not succeed, and the like, the process returns to step S12. Therefore, when the authentication does not succeed, the process cannot proceed to the next step S16.

In step S16, the control part 22 instructs the power source relay 27 to supply electric power to the outboard motor 40. This processing corresponds to one example of processing performed by an electric power supply instruction means. Concretely, when the control part 22 turns on the power source relay 27, the electric power is supplied to the outboard motor 40 from the battery 29 via the power source cable 33. Under this state, the electric power is supplied also to the accessory 50 from the battery 29, so that the boat operator can use the accessory 50. A state in which the electric power is supplied to the outboard motor 40 and the accessory 50 without starting the outboard motor 40 as described above is set to be referred to as an ignition-on state. On the other hand, a state where the power source relay 27 is in an off state, and the electric power is not supplied to the outboard motor 40 and the accessory 50 from the battery 29 is set to be referred to as an ignition-off state.

In step S17, the control part 22 performs communication with the ECU 41 of the outboard motor 40 via the communication cable 32, and instructs the outboard motor 40 to cancel the security. This processing corresponds to one example of processing performed by a security cancellation instruction means. Concretely, the control part 22 transmits, to the outboard motor 40, an order to cancel the security. The control part 42 of the ECU 41 of the outboard motor 40 cancels the security in accordance with the order. Note that when the security is not being executed, the control part 22 omits step S17.

In step S18, the control part 22 determines whether or not the start SW 30 is turned on by the boat operator. Here, a case where the boat operator presses-down the start SW 30 for starting the outboard motor 40 from the ignition-on state, and a case where the boat operator presses-down the start SW 30 for returning the ignition-on state to the ignition-off state after finishing the use of the accessory 50, for example, exist. When the start SW 30 is turned on, the process proceeds to step S19, and when it is not turned on, the control part 22 waits until the start SW 30 is turned on.

In step S19, the control part 22 performs communication with the outboard motor 40, and determines whether or not the outboard motor 40 is being driven. Concretely, the control part 22 obtains information regarding an engine speed from the control part 42 of the outboard motor 40, and determines whether or not the engine speed is 0 (zero). When the outboard motor 40 is not being driven, the process proceeds to step S20. When the outboard motor 40 is being driven, the process proceeds to step S22. When the process proceeds to step S19 for the first time after starting the flowchart in FIG. 3, the process proceeds to step S20 since the outboard motor 40 is not being driven.

In step S20, the control part 22 determines whether or not the emergency SW 31 is on. This processing corresponds to one example of processing performed by a determination means. When the emergency SW 31 is not on, the process proceeds to step S21, and the control part 22 transmits, to the outboard motor 40, an instruction of starting the outboard motor 40. This processing corresponds to one example of processing performed by a start instruction means. The control part 42 of the outboard motor 40 starts the outboard motor 40 in accordance with the instruction. Concretely, the control part 42 injects the fuel with the use of the injector 44 while rotating the starter motor 47 via the starter relay 46, and ignites the ignition plug via the ignition coil 45, to thereby start the engine.

On the other hand, when the emergency SW 31 is on, the process proceeds to step S23, and the control part 22 makes the process proceed to processing of later-described step S23 and thereafter in which the supply of electric power to the outboard motor 40 is stopped.

In the outboard motor system 100 of the present embodiment, when the emergency SW 31 is off at the time of turning on the start SW 30 under the ignition-on state, the outboard motor 40 is started, and when the emergency SW 31 is on, the outboard motor 40 is not started, and the ignition-on state shifts to the ignition-off state. Therefore, through a relatively simple operation in which the boat operator presses-down the start SW 30 under the state where the insertion/extraction member is extracted from the emergency SW 31, it is possible to make the ignition-on state shift to the ignition-off state without starting the outboard motor 40.

Next, after the outboard motor 40 is started in step S21, the process returns to step S18, and the control part 22 determines whether or not the start SW 30 is turned on. When the start SW 30 is turned on, the process proceeds to step S19. In step S19, it is determined that the outboard motor 40 is being driven, and the process proceeds to step S22.

In step S22, the control part 22 transmits, to the outboard motor 40, an instruction of stopping the outboard motor 40. This processing corresponds to one example of processing performed by a stop instruction means. The control part 42 of the outboard motor 40 stops the outboard motor 40 in accordance with the instruction. Concretely, the control part 42 stops the injection conducted by the injector 44, and stops the ignition using the ignition plug via the ignition coil 45. As described above, in the state where the outboard motor 40 is being driven, the boat operator can stop the outboard motor 40 by turning on the start SW 30.

In step S23, the control part 22 performs wireless communication with the portable machine 10, and performs an authentication of the portable machine 10. This processing is similar to that in step S14. Therefore, also in step S23, the authentication is performed as long as the boat operator who carries the portable machine 10 exists in the hull 2.

In step S24, the control part 22 performs an authentication whether or not the received encryption code coincides with the collation code stored in the storage part 23. When the encryption code and the collation code coincide with each other and the authentication is succeeded, the process proceeds to step S25. Note that in the case where the encryption code and the collation code do not coincide with each other and the authentication does not succeed, and the like, the process proceeds to step S26.

In step S25, the control part 22 performs communication with the ECU 41 of the outboard motor 40, and instructs the outboard motor 40 to execute the security. Concretely, the control part 22 transmits, to the outboard motor 40, an order to execute the security. The control part 42 of the ECU 41 executes the security in accordance with the order. Upon receiving, from the control part 42 of the ECU 41, information indicating that the security is executed, the control part 22 notifies the boat operator that the security is executed, via the notification part 26. Further, the control part 22 can store the information indicating that the security is executed, in the storage part 23. Note that when the authentication does not succeed in step S24 described above, the security in step S25 is not executed. This is because a case where the boat operator loses the portable machine 10 after dropping it in water, is supposed. Specifically, by preventing the execution of security when the boat operator drops the portable machine 10 in water and the authentication does not succeed, it is possible to start the outboard motor 40 even with no portable machine 10 at the time of starting the flowchart in FIG. 3 next time.

In step S26, the control part 22 turns off the power source relay 27. When the power source relay 27 is turned off, the shift to the ignition-off state in which the supply of electric power to the outboard motor 40 and the accessory 50 is stopped is realized.

In step S27, the control part 22 determines whether or not the battery SW 28 is turned off by the boat operator. When the battery SW 28 is turned off, the process proceeds to step S28. When the battery SW 28 is not turned off, the process returns to step S12, in which the determination whether or not the start SW 30 is turned on is conducted again.

In step S28, the control part 22 turns off the power source of the start control device 20 including the smart unit 21, resulting in that the processing of the outboard motor system 100 is terminated.

Figure 4:
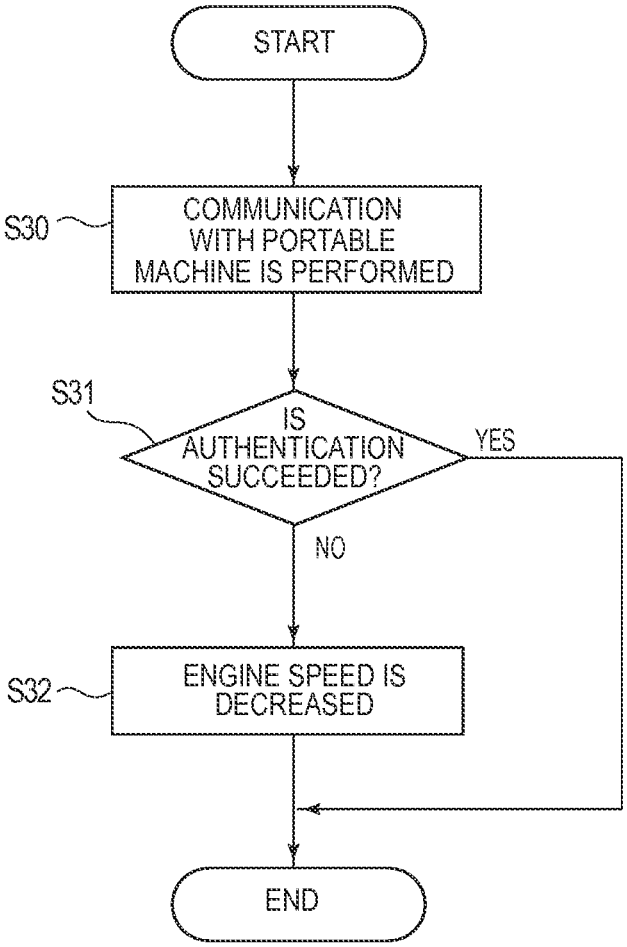
FIG. 4 is a flowchart illustrating processing of the start control device for the outboard motor.

Next, processing after the outboard motor 40 is started in step S21 in the flowchart in FIG. 3 will be described with reference to a flowchart in FIG. 4. The flowchart illustrated in FIG. 4 is realized when the control part 22 of the smart unit 21 in the start control device 20 executes the program stored in the storage part 23. The control part 22 executes the processing in the flowchart illustrated in FIG. 4 at fixed intervals.

In step S30, the control part 22 performs wireless communication with the portable machine 10 via the communication part 24, and performs an authentication of the portable machine 10. This processing is similar to that in step S14. Therefore, also in step S30, the authentication is performed as long as the boat operator who carries the portable machine 10 exists in the operation cabin 4.

In step S31, the control part 22 performs an authentication whether or not the received encryption code coincides with the collation code stored in the storage part 23. When the encryption code and the collation code coincide with each other and the authentication is succeeded, the processing is terminated. On the other hand, when the authentication does not succeed, the process proceeds to step S32.

In step S32, the control part 22 performs communication with the ECU 41 of the outboard motor 40, and gives an instruction of decreasing the power of the outboard motor 40. This processing corresponds to one example of processing performed by a power instruction means. The control part 42 of the ECU 41 of the outboard motor 40 decreases the power of the outboard motor 40, namely, it decreases the engine speed, in accordance with the instruction.

As described above, the reason why the control part 22 performs the authentication of the portable machine 10 after starting the outboard motor 40, is because the case where the boat operator drops the portable machine 10 in water is supposed. Specifically, the case where the authentication does not succeed also includes a case where the portable machine 10 is dropped in water and thus the control part 22 cannot receive the encryption code from the portable machine 10. By taking such a case into consideration, the control part 22 performs the authentication with the portable machine 10 at fixed intervals, and when the authentication does not succeed, by decreasing the power of the outboard motor 40, it is possible to make it easy for the boat operator to perform searching on a surface of water in the periphery of the outboard motor 40.

As described above, according to the present embodiment, through a relatively simple operation such that the boat operator presses-down the start SW 30 in the state where the insertion/extraction member is extracted from the emergency SW 31, it is possible to shift the ignition-on state to the ignition-off state. Therefore, even when the boat operator uses only the accessory 50, for example, under the ignition-on state, it is possible to shift the ignition-on state to the ignition-off state in which the supply of electric power to the outboard motor 40 is stopped, without starting the outboard motor 40.

Further, the emergency SW 31 is normally a switch used after starting the outboard motor 40, and normally, it is not used before starting the outboard motor 40. Therefore, by performing, with the use of the emergency SW 31 which is used only after the start of the outboard motor 40, the switching whether to start the outboard motor 40 or to stop the supply of electric power to the outboard motor 40, it is not necessary to newly add a switch for performing the switching, and thus there is no chance of increasing the product cost.

Further, according to the present embodiment, since the plurality of communication parts 24 each capable of performing the wireless communication with the portable machine 10 are disposed in the hull 2, it is possible to perform the wireless communication with the portable machine 10 as long as the boat operator who carries the portable machine 10 exists in the hull 2. Therefore, as long as the boat operator who carries the portable machine 10 exists in the hull 2, even another person can perform the operation for making the outboard motor 40 cancel the security or execute the security, resulting in that a convenience of the outboard motor system 100 can be improved.

Figure 5:
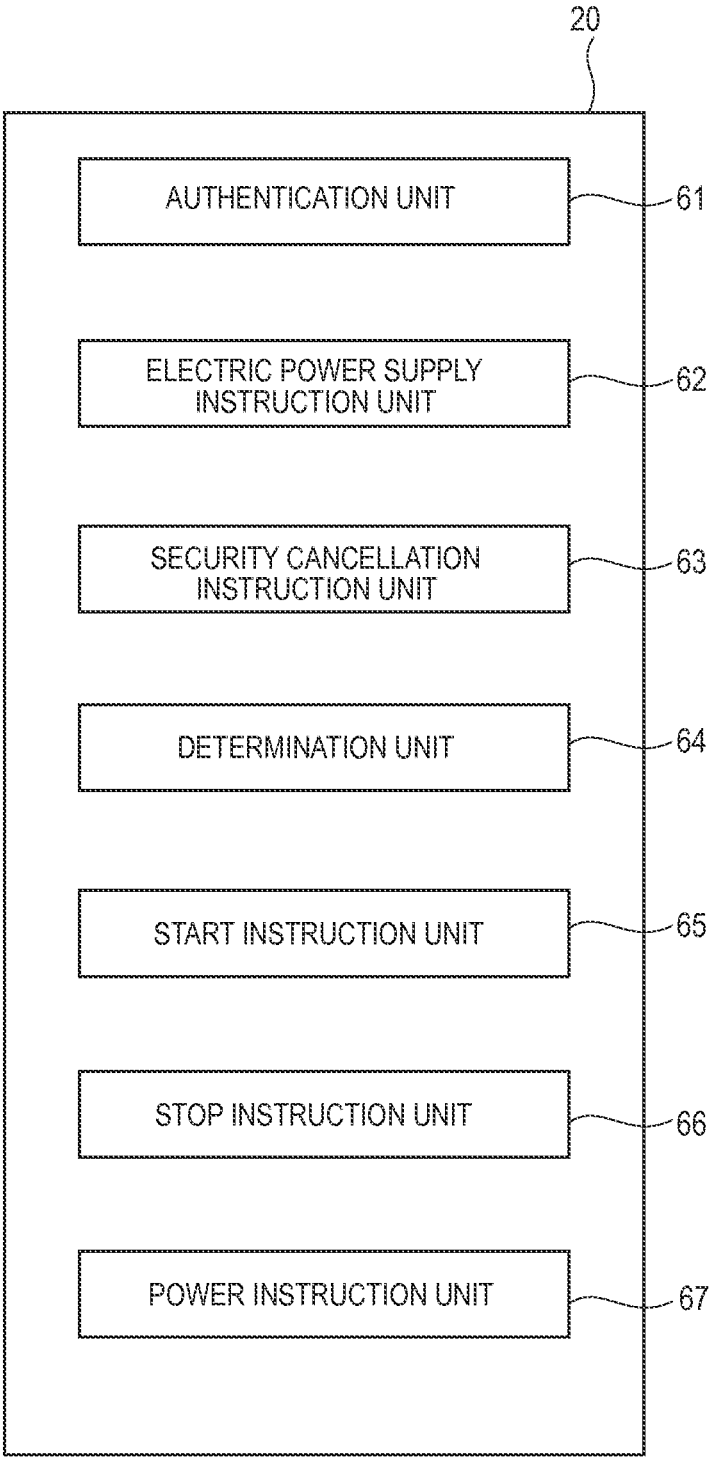
FIG. 5 is a diagram illustrating a functional configuration of the start control device.

FIG. 5 is a diagram illustrating one example of a functional configuration of the start control device for the outboard motor. The functional configuration illustrated in FIG. 5 is realized when the control part 22 executes the program stored in the storage part 23.

The start control device 20 is configured by including an authentication unit 61, an electric power supply instruction unit 62, a security cancellation instruction unit 63, a determination unit 64, a start instruction unit 65, a stop instruction unit 66, and a power instruction unit 67.

The authentication unit 61 performs the authentication of the portable machine 10 carried by the boat operator via the communication part 24.

When the authentication of the portable machine 10 is succeeded, the electric power supply instruction unit 62 instructs the supply of electric power to the outboard motor 40.

When the authentication of the portable machine 10 is succeeded, the security cancellation instruction unit 63 instructs the cancellation of security of the outboard motor 40.

The determination unit 64 determines, when the start SW 30 is turned on, whether or not the emergency SW 31 is on.

The start instruction unit 65 instructs the start of the outboard motor 40.

The stop instruction unit 66 instructs the stop of the supply of electric power to the outboard motor 40.

The power instruction unit 67 instructs the outboard motor 40 to increase or decrease the power.

In the foregoing, the present invention has been described by the above-described embodiment, but, the present invention is not limited only to the above-described embodiment, and a change can be made within the scope of the present invention.

For example, although the above-described embodiment describes the case where the boat operator instructs the start of the outboard motor 40 or the stop of the outboard motor 40 by using the start SW 30, the present invention is not limited to this case. For example, it is also possible to configure such that the start of the outboard motor 40 is instructed or the stop of the outboard motor 40 is instructed via a switch provided to the portable machine 10. Therefore, in step S12 and step S18 described above, it is determined whether or not the start SW 30 is turned on, but, it is also possible to determine whether or not the switch of the portable machine 10, instead of the start SW 30, is turned on. For example, in step S12 and step S18, it is also possible to determine whether or not a long pressing of the up SW 15 or the down SW 16 is conducted, and it is also possible to determine whether or not a switch which is different from the up SW 15 or the down SW 16 and is newly provided to the portable machine 10, is turned on.

Further, the above-described embodiment describes the case where the control part 22 turns on or off the power source relay 27 as the instruction of supplying electric power or stopping the supply of electric power to the outboard motor 40. However, the present invention is not limited to this case, and it is also possible to design such that the power source relay 27 is omitted, the control part 22 directly instructs the battery 29 to supply electric power or stop the supply of electric power to the outboard motor 40, and the battery 29 supplies electric power or stops the supply of electric power to the outboard motor 40 in accordance with the instruction.

Note that the processing after the outboard motor 40 starts includes processing in which the control part 22 adjusts the power of the outboard motor 40 in accordance with the signal of the up SW 15 or the down SW 16 received from the portable machine 10. The control part 22 transmits, every time it receives the signal of the up SW 15 or the down SW 16, an instruction of increasing or decreasing the engine speed (power) of the outboard motor 40 within the low speed range (within a low power range). The control part 42 of the ECU 41 of the outboard motor 40 increases or decreases, in accordance with the instruction, the engine speed (power) of the outboard motor 40 within the low speed range (within the low power range).

Further, although the present embodiment describes the case where the above-described processing is realized when the control part 22 executes the program, the present invention is not limited to this case, and it is also possible that respective circuits configured by hardware execute the above-described processing.

Further, the present invention includes the above-described program and a computer readable recording medium which records the program.

INDUSTRIAL APPLICABILITY

The present invention can be utilized when cancellation and execution of security of an outboard motor are conducted by using an electronic key.

The invention claimed is:

1. A start control device for an outboard motor performing a control to start and stop the outboard motor in accordance with an instruction made by a boat operator, the start control device for the outboard motor comprising:

an authentication means performing an authentication of a portable machine carried by the boat operator via a communication part in accordance with an operation of a first switch made by the boat operator;

an electric power supply instruction means instructing a supply of electric power to the outboard motor based on a success of the authentication of the portable machine performed by the authentication means;

a security cancellation instruction means instructing a cancellation of security of the outboard motor based on the success of the authentication of the portable machine performed by the authentication means;

a rotation speed determination means determining whether or not a rotation speed of an engine of the outboard motor is 0 (zero), when the first switch is operated by the boat operator in the state where the electric power is supplied to the outboard motor in accordance with the instruction made by the electric power supply instruction means, and the security of the outboard motor is cancelled in accordance with the instruction made by the security cancellation instruction means;

a determination means determining whether or not an emergency switch is on when the rotation speed determination means determines that the rotation speed is 0 (zero);

a start instruction means instructing a start of the engine of the outboard motor when the rotation speed determination means determines that the rotation speed of the engine is 0 (zero), and when the determination means determines that the emergency switch is not on; and a stop instruction means instructing a stop of the engine of the outboard motor when the rotation speed determination means determines that the rotation speed is not 0 (zero), and instructing a stop of the supply of electric power to the outboard motor when the rotation speed determination means determines that the rotation speed of the engine is 0 (zero), and when the determination means determines that the emergency switch is on.

2. The start control device for the outboard motor according to claim 1, further comprising a power instruction means instructing the outboard motor to increase or decrease a power, wherein the power instruction means instructs the outboard motor to decrease the power when the outboard motor is started and then the authentication performed by the authentication means is not succeeded.

3. The start control device for the outboard motor according to claim 1 or 2, wherein a plurality of the communication parts are disposed in a hull.

4. A start control method for an outboard motor performing a control to start and stop the outboard motor in accordance with an instruction made by a boat operator, the start control method for the outboard motor comprising:

an authentication step of performing an authentication of a portable machine carried by the boat operator via a communication part in accordance with an operation of a first switch made by the boat operator;

an electric power supply instruction step of instructing a supply of electric power to the outboard motor based on a success of the authentication of the portable machine performed by the authentication step;

a security cancellation instruction step of instructing a cancellation of security of the outboard motor based on the success of the authentication of the portable machine performed by the authentication step;

a rotation speed determination step of determining whether or not a rotation speed of an engine of the outboard motor is 0 (zero), when the first switch is operated by the boat operator in the state where the electric power is supplied to the outboard motor in accordance with the instruction made by the electric power supply instruction step, and the security of the outboard motor is cancelled in accordance with the instruction made by the security cancellation instruction step;

a determination step of determining whether or not an emergency switch is on when the rotation speed determination step determines that the rotation speed is 0 (zero);

a start instruction step of instructing a start of the engine of the outboard motor when the rotation speed determination step determines that the rotation speed of the engine is 0 (zero), and when the determination step determines that the emergency switch is not on; and a stop instruction step of instructing a stop of the engine of the outboard motor when the rotation speed determination step determines that the rotation speed is not 0 (zero), and instructing a stop of the supply of electric power to the outboard motor when the rotation speed determination step determines that the rotation speed of the engine is 0 (zero), and when the determination step determines that the emergency switch is on.

5. A program for performing a control to start and stop an outboard motor in accordance with an instruction made by a boat operator, the program causing a computer to execute:

an authentication step of performing an authentication of a portable machine carried by the boat operator via a communication part in accordance with an operation of a first switch made by the boat operator;

an electric power supply instruction step of instructing a supply of electric power to the outboard motor based on a success of the authentication of the portable machine performed by the authentication step;

a security cancellation instruction step of instructing a cancellation of security of the outboard motor based on the success of the authentication of the portable machine performed by the authentication step;

a rotation speed determination step of determining whether or not a rotation speed of an engine of the outboard motor is 0 (zero), when the first switch is operated by the boat operator in the state where the electric power is supplied to the outboard motor in accordance with the instruction made by the electric power supply instruction step, and the security of the outboard motor is cancelled in accordance with the instruction made by the security cancellation instruction step;

a determination step of determining whether or not an emergency switch is on when the rotation speed determination step determines that the rotation speed is 0 (zero);

a start instruction step of instructing a start of the engine of the outboard motor when the rotation speed determination step determines that the rotation speed of the engine is 0 (zero), and when the determination step determines that the emergency switch is not on; and a stop instruction step of instructing a stop of the engine of the outboard motor when the rotation speed determination step determines that the rotation speed is not 0 (zero), and instructing a stop of the supply of electric power to the outboard motor when the rotation speed determination step determines that the rotation speed of the engine is 0 (zero), and when the determination step determines that the emergency switch is on.

* * * * *